US006433704B1

(12) United States Patent
Fushiki et al.

(10) Patent No.: US 6,433,704 B1
(45) Date of Patent: Aug. 13, 2002

(54) COMMUNICATION DEVICE OF MOVING BODY INFORMATION AND COMMUNICATION METHOD THEREOF

(75) Inventors: Takumi Fushiki, Hitachi; Takayoshi Yokota, Hitachiohta; Kenichiro Yamane, Hitachi; Seiji Ukai, Koganei, all of (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 09/708,563

(22) Filed: Nov. 9, 2000

(30) Foreign Application Priority Data

Jun. 13, 2000 (JP) ..... 2000-182318

(51) Int. Cl.[7] ..... G08G 1/09
(52) U.S. Cl. ..... 340/905; 340/539; 340/989
(58) Field of Search ..... 340/434, 539, 340/905, 988, 990, 995, 989; 701/200, 201, 209, 210, 212, 118, 119, 120

(56) References Cited

U.S. PATENT DOCUMENTS 5,173,691 A * 12/1992 Sumner ..... 340/905
5,911,773 A * 6/1999 Mutsuga et al. ..... 340/990
5,991,689 A * 11/1999 Aito et al. ..... 701/209

* cited by examiner

*Primary Examiner*—Van Trieu
(74) *Attorney, Agent, or Firm*—Antonelli, Terry, Stout & Kraus, LLP

(57) ABSTRACT

Information requesting sides 2*a*~2*d* request to a moving body information communication device 1 information, the moving body information communication device 1 transmits the information request to probe cars 3*a*~3*c* of which existence in its managing area is confirmed by itself, the probe cars 3*a*~3*c* return obtained moving body information meeting the information request to the moving body information communication device 1, and the moving body information communication device 1 transmits the received moving body information to the information requesting sides 2*a*~2*d*. Thereby, a moving body information communication system is provided which permits to obtain moving body information in response to the request from the information requesting sides.

12 Claims, 8 Drawing Sheets

| BEGIN TIME | INFORMATION KIND | START POSITION | END POSITION | VIA POINT 1 | VIA |
|---|---|---|---|---|---|
| 19:30 | JAMMING INFORMATION | 139° 12'34.5"E<br>35° 12'34.5"N | 139° 23'45.6"E<br>35° 23'45.6"N | 139° ···<br>35° ··· | |
| 19:30 | JAMMING INFORMATION | 139° 23'45.6"E<br>35° 23'45.6"N | 139° 34'56.7"E<br>35° 34'56.7"N | 139° ···<br>35° ··· | |
| | | | | | |

FIG. 5

| INFORMATION KIND | FRESHNESS THRESHOLD VALUE |
|---|---|
| JAMMING INFORMATION | 10 MIN. |
| TIME NECESSARY | 5 MIN. |
| ROUTE IMAGE | 10 MIN. |
| | |

FIG. 6

| BEGIN TIME | INFORMATION KIND | START POSITION | END POSITION | VIA POINT 1 |
|---|---|---|---|---|
| 19:23 | JAMMING INFORMATION | 139° 11'11.1"E<br>35° 11'11.1"N | 139° 22'22.2"E<br>35° 22'22.2"N | AVERAGE 10km/h |
| 19:24 | JAMMING INFORMATION | 139° 22'22.2"E<br>35° 22'22.2"N | 139° 34'56.7"E<br>35° 23'56.7"N | AVERAGE 12km/h |
| 19:06 | TIME NECESSARY | 139° 22'22.2"E<br>35° 22'22.2"N | 139° 11'11.1"E<br>35° 22'22.2"N | 193 SEC. |
| 19:24 | TIME NECESSARY | 139° 22'22.2"E<br>35° 22'22.2"N | 139° 11'11.1"E<br>35° 22'22.2"N | 1020 SEC. |
| | | | | |

| OBTAIN TIME | MOVING BODY ID | POSITION |
|---|---|---|
| 19:23 | 10001 | 139° 11'11.1"E<br>35° 11'11.1"N |
| 19:24 | 10002 | 139° 22'22.2"E<br>35° 22'22.2"N |
| 19:06 | 10003 | 139° 22'22.2"E<br>35° 22'22.2"N |
| 19:24 | 10004 | 139° 22'22.2"E |

COMMUNICATION DEVICE OF MOVING BODY INFORMATION AND COMMUNICATION METHOD THEREOF

BACKGROUND OF THE INVENTION

1. Field of the Invention

The present invention relates to a communication device of moving body information, and in particular, relates a moving body information communication device and system in which information is obtained from a moving body for detecting moving body information.

2. Conventional Art

A conventional information exchanging system between moving bodies is disposed, for example, in JP-A-9-180094 (1997), in which through a navigation device provided with a traffic jam judging means which judges whether the own car is included into a traffic jam and with a communication device which exchanges information with other cars, traffic jam information is exchange with cars passing each other as well as such communication information wire tapped by a fixed station is provided to other moving body vehicles.

Further, as disposed in JP-A-11-86184 (1999) a system is known in which information is collected to a center from probe cars and the collected information is transmitted from the center to a moving body vehicle requesting concerned information.

The above conventional art does not take into account of collecting information with regard to specific regions from moving bodies in response to an information from an information requesting side. Further, in order to collect information, it was necessary that information exchanged by moving body vehicles is wire-trapped or a fixed station has to inquire traffic jam information to respective moving body vehicles.

SUMMARY OF THE INVENTION

An object of the present invention is to provide a moving body information communication device which can obtain moving body information in response to information request from an information requesting side.

Further, another object of the present invention is to provide a moving body information communication system which distributes processings of information collected by moving bodies.

A moving body information communication device according to the present invention which achieves the above object is characterized, in that the moving body information communication device is provided with a first communication means which receives request information from an information requesting side and a second communication means which transmits the request information to at least one moving body existing at a predetermined region, wherein when moving body information corresponding to the request information is transmitted from the moving body, the moving body information is transferred to the information requesting side.

Further, the moving body information transmission device according to the present invention further comprises a memory which stores moving body information always receiving from the moving body, and when the request information is stored in the memory, the moving body information transmission device reads the stored information and transfers the same to the information requesting side and when no request information is stored in the memory, the device transmits the request information to the moving body.

Still further, the moving body information stored in the memory is classified according to its freshness and when the freshness of the information is within a freshness threshold value, the moving body information is determined to be transferable to the informating requesting side.

Still further, when the request information is not stored in the memory, it is judged whether the communication traffic of the moving body information communication device is within a predetermined allowable value, and when the communication traffic is within the predetermined allowable value, the device transmits the request information to the moving body. Thereby, when a load of the moving body information communication device is high, the inquiry to the moving body is suppressed.

Still further, according to the present invention a plurality of the moving body information communication devices are connected through a network and in each of which a moving body management means is provided which receives moving body identification and position information periodically declared by the moving body and manages the same.

BRIEF DESCRIPTION OF THE DRAWINGS

FIG. 5 is a view for explaining threshold value of information freshness in FIG. 1 embodiment;

FIG. 6 is a format diagram of moving body information in FIG. 1 embodiment;

EXPLANATION OF THE PREFERRED EMBODIMENTS

Moving body information as referred to in the present invention is defined as information including at least specific information possessed by a moving body itself, information collected by making use of a measurement instrument and a sensor provided at the moving body itself and secondary information which is possessed or obtained by other mediums through wire-trapping by a communication means provided at the moving body.

The specific information of the moving body itself includes, for example, ID information of the moving body such as ID number, ID address and telephone number and the type information such as type of the moving body and type of a terminal provided at the moving body. Therefore, in order to hold such specific information, it is necessary to provide a memory means at the moving body.

The information collected by the moving body includes, for example, required time information necessitated when the moving body travels between certain points, travel route information of the moving body, speed history information and acceleration speed history in the route, audio information obtained by a recording device provided at the moving body, image information obtained by a camera, and further information edited by making use of the obtained information such as traffic jam section information and traffic jam circumference information. In order to collect and edit the above information the moving body is provided with a variety of measurement instruments, sensor and processing units which vary depending on types of information to be obtained.

The secondary information wire trapped by the moving body includes, for example, the specific information and collected information possessed by other moving bodies and information obtained from a broadcasting media. In order to wire trap the secondary information, it is necessary that the moving body is provided with a communication means which permits communication with other moving bodies.

What enables to obtain the above moving body information in response to request from the information request side is the moving body information communication device and system according to the present invention. Therefore, it is a pre-condition that the moving body which is the subject of the present invention is provided with at least means for holding the moving body information, a communication receiving means which receives request of moving body information from the information requesting side and a communication transmission means which transmits the holding moving body information in response to the request. In the following embodiments according to the present invention, as an example of the moving body an automobile vehicle (hereinafter called as vehicle) is exemplified, however, if the above three means are included, the moving body can be rolling stocks, light weight vehicles, ships, airplanes and persons bearing a portable terminal.

Figure 1:
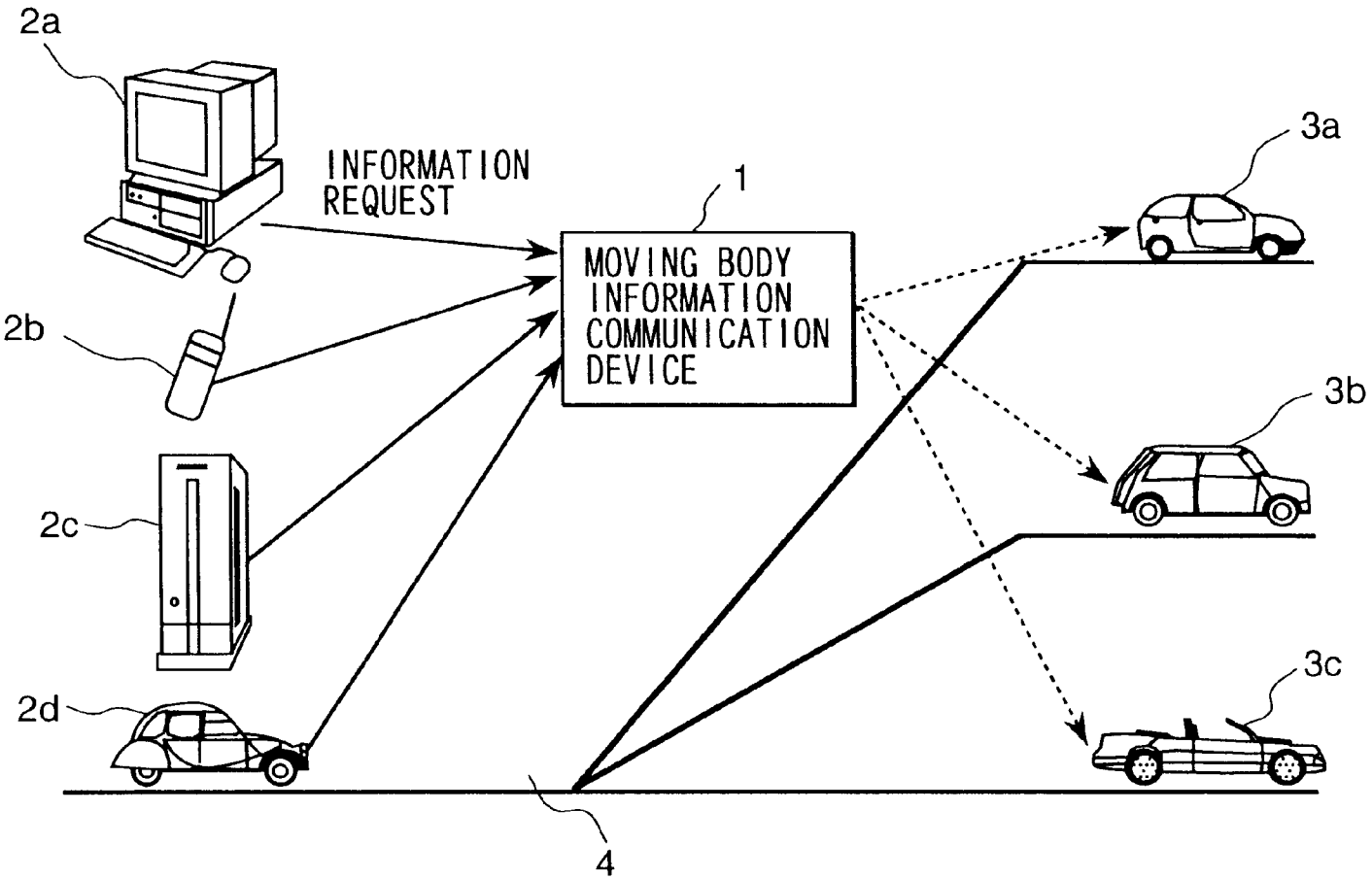
FIG. 1 is a schematic constitution diagram of a moving body information communication system representing an embodiment according to the present invention.

Hereinbelow, embodiments according to the present invention will be explained with reference to the drawings. At first a case where a center is constituted by a single server will be explained. FIG. 1 is a constitutional diagram of a system in which a moving body information communication device according to the present invention is applied wherein numeral 1 represents a moving body information communication device 1, numerals 2*a*, 2*b*, 2*c* and 2*d* represent information requesting sides, numerals 3*a*, 3*b* and 3*c* represent vehicles (probe cars) holding moving body information and numeral 4 represents a road network.

The information requesting sides 2*a*~2*d* respectively represent a personal computer, a mobile terminal, an information collecting unit and an information requesting vehicle. Each of them generates information request in connection with region A and transmits the same to the moving body information communication device 1. A method of generating the information request and a method of communicating the same can be varied depending on the types of the information request sides. For example, with the personal computer 2*a* while displaying a map image on the screen, an information request point and an information request content are inputted on the screen image and the request is transmitted via a modem and a telephone line to the moving body information communication device 1. With the mobile terminal 2*b* the information request is inputted through voices or key manipulation and is transmitted via a wireless phone or a satellite communication line to the moving body information communication device 1. With the information collection unit 2*c* the information request is generated by a user input or periodically and is transmitted via an exclusive communication line to the moving body information communication device 1. With the information requesting vehicle 2*d*, the information request of a driver or a passenger is inputted by making use of input keys or an audio input on a car navigation unit and is communicated via a local wireless communication to the moving body information communication device 1. The methods of generating the information request and the methods of communicating the same can be combined in different manners as exemplified above.

Figures 2, 4:
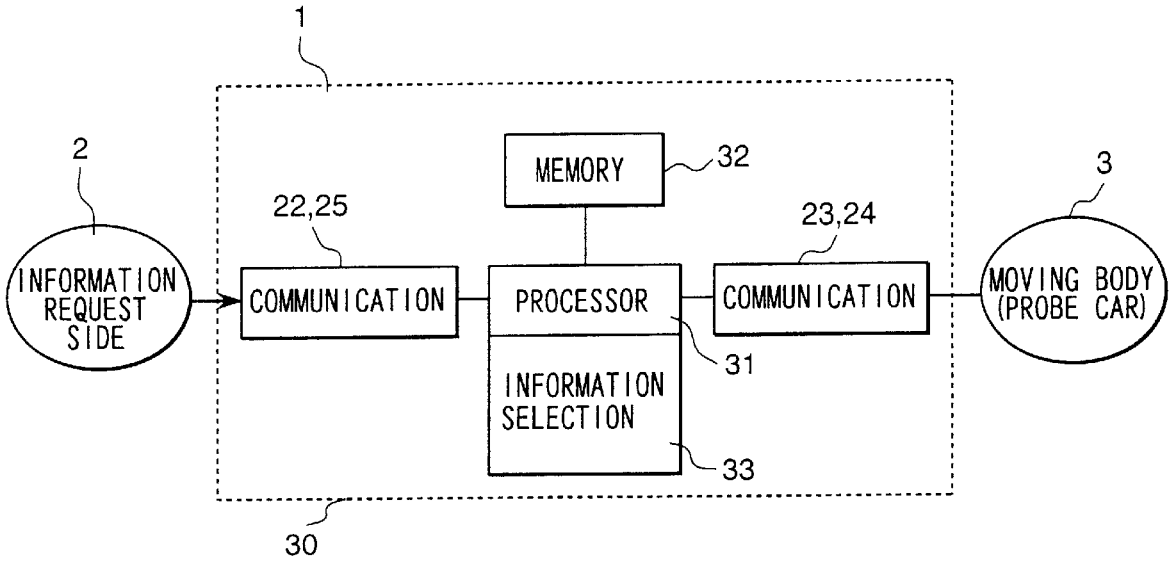
FIG. 2 is a functional block diagram of a moving body information communication device in FIG. 1 embodiment.
FIG. 4 is a format diagram of request information in FIG. 1 embodiment.

FIG. 2 is an example of a moving body information communication device 1 which transmits the information request to a probe car. The moving body information communication device 1 which has received information request transfers the information request to probe cars 3*a*, 3*b* and 3*c* of which existence in region A managing by itself is recognized by the device.

The communication means 22 functions to receive information request from an information request side 2 and to convert the same into input data signals for a processor 31, and is provided with a plurality type of signal receiving modules so as to meet respective communication mediums of the information request sides. Such modules are for instance provided, in that when communicating via a telephone line a modem, when communicating via a digital line such as ISDN, a DSU (Digital Serve Unit) and TA (Terminal Adopter), when communicating via a LAN connection a router, when communicating via a cellular phone a wireless base station, and when utilizing a satellite communication a satellite antenna.

The processor 31 converts the information request into input data signals for a communication means 23 and transfers the same to the communication means 23. The communication means 23 converts the information request into broadcast type communication signals and transmits the same to probe cars. In response to the received information request, the probe car returns to a communication means 24 information which is held by itself and satisfies the information request or information which is collected and prepared thereby and satisfies the information request. When communication means 23 transmits the information request, if ID information of the information requesting side is transmitted together, it is possible that a moving body probe car surely transmits the moving body information toward the very information requesting side specified by ID issuing the information request.

An information selection means 33 causes to store into a memory 32 moving body information which is requested by an information request side and is received by the communication means 24 in the course of obtaining the same. The information selection means 33 further selects proper moving body information as an answer to the information requesting side with reference to the information request received by the communication means 22 and in response to the information request contents, freshness of required moving body information and frequency of the communication traffic.

A communication means 24 is a communication unit which receives responding moving body information from a probe car. When a communication mode with the probe car is a bidirectional communication, it is possible to form the communication means 23 and the communication means 24 into a single unit. A communication means 25 is a communication unit which transmits the moving body information for the information requesting side. With regard to the communication means 22 and the communication means 25 likely when the communication mode with the information requesting side is bidirectional communication, it is possible to form the both means into a single unit.

When the moving body information communication device 1 receives the moving body information by means of the above respective means and combinations thereof, it looks like when seen from the information requesting side as if the moving body information communication device 1 answers the moving body information in response to the information request. Likely, when seen from the probe car, it looks like as if the moving body information communication device 1 issues the information request. Accordingly, with the provision of the moving body information communication device 1 exchange of moving body information between the information requesting side and the probe car is realized, however, no direct exchange of ID information is generated. Thereby, even in a system in which the moving body information is distributively held by a plurality of probe cars, moving body information can be collected from many number of unidentified probe cars while protecting privacy of respective information requesting sides each other.

Figure 3:
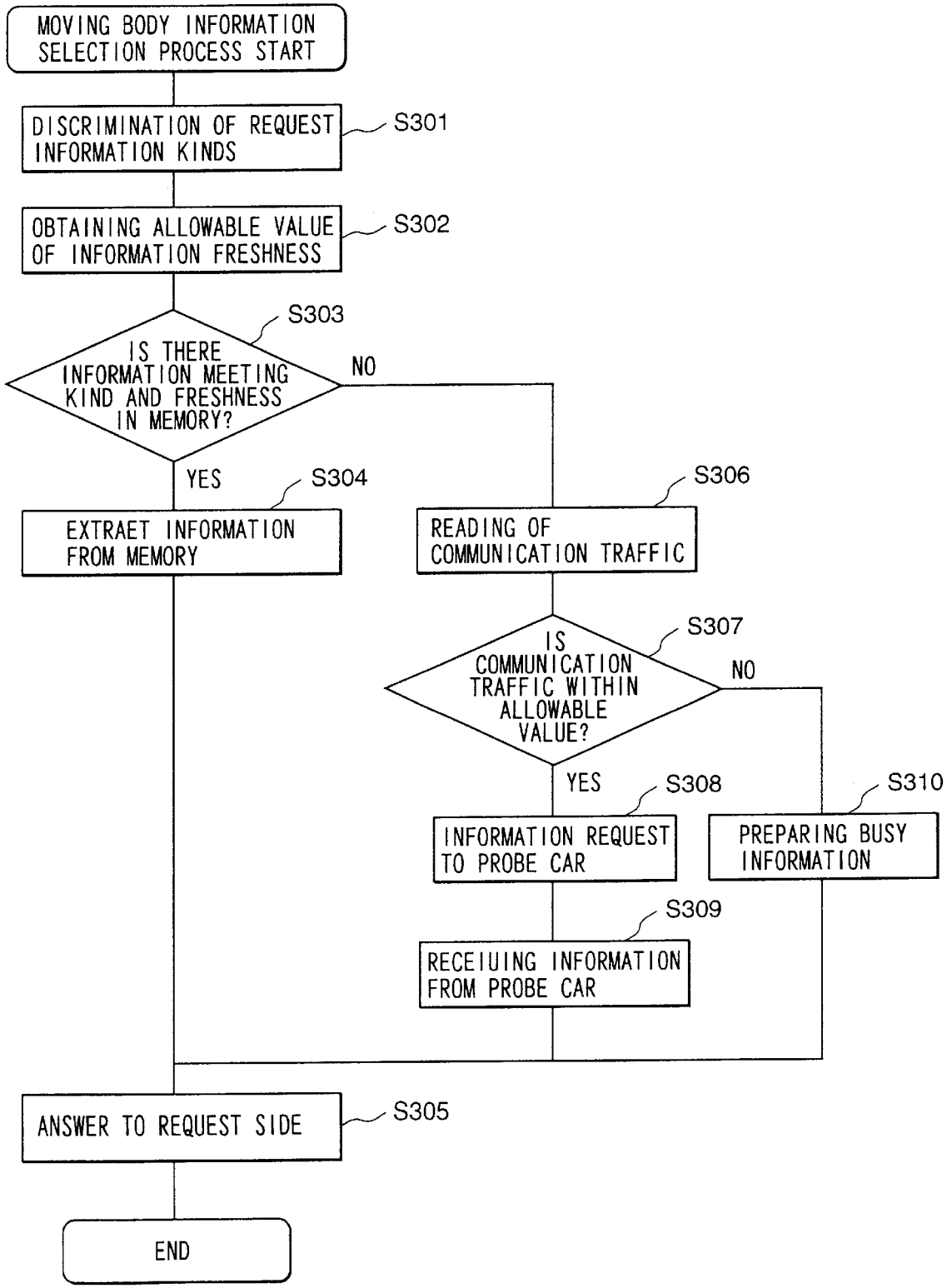
FIG. 3 is a flowchart of moving body information selection processing in FIG. 1 embodiment.

With reference to FIG. 3 a processing flow in the information selection means 33 will be explained. At first information request is read and the contents thereof is discriminated (S 301). The contents included in the information request include types of moving body information required by the information requesting side and position thereof. Subsequently, a freshness allowable value for the requested moving body information is obtained (S 302).

In FIG. 4, a format example of request information is shown and in FIG. 5, a threshold value example of information freshness is shown. In the request information format, begin time, information types such as jamming information and necessary time information, start position, end position and via points are, for example, included. Further, the threshold values of information freshness are set for every information type, for example, for jamming information as 10 min. and necessary time information as 5 min. The information freshness indicates time lapsed after obtaining the moving body information, and by adding a time stamp at the time when the same is stored in the memory 32 on the moving body information, the freshness of the moving body information threshold value represents upper freshness limit value which is acceptable to the information requesting side as information satisfying the request.

As processing S 303 it is checked whether information meeting the request type and freshness is stored in the memory. If such is determined stored, the information is extracted from the memory (S 304), and is transmitted to the information requesting side (S 305). If the answer at processing S 303 is NO, reading of the communication traffic is performed at processing S 306 and it is judged whether the communication traffic is within a predetermined allowable value (S 307). If the communication traffic is within the predetermined allowable value, a command for newly obtaining movable body information held by the probe cars is sent to the processor 31. The processor 31 transmits the information request via the communication means 23 to the probe cars (S 308) and receives the moving body information via the communication means 24.

Information received from probe cars is once stored in the memory 32, thereafter, a command for newly obtaining moving body information held by the probe cars is sent to the processor 31. The received moving body information is stored in the memory after adding a time stamp thereon as well as is transmitted via the communication means 25 to the information requesting side. Further, when the communication traffic is out of the predetermined allowable value, busy information is prepared at processing S 310 and is sent to the information requesting side.

FIG. 6 shows a memory format, in that format received from the probe cars, in which obtain time, information types such as jamming information and necessary time information, start position and end position are included as well as parameters such as average speed and necessary time obtained by the probe cars are included.

With the provision of the moving body information selection means 33 which performs the above processings, the moving body information communication device and system according to the present embodiment can vary frequency of information collection depending on types of moving body information requested from the information requesting side. For example, when obtaining information requiring an intense real time characteristic such as jamming information, it is possible that the information requesting side requires the newest information. At this moment if the information traffic is less, it is possible to obtain information from the probe cars directly. However, if the information traffic is many, renewal frequency of the moving body information in the memory becomes high, resultantly, it becomes possible to obtain comparatively new jamming information from the memory.

Figure 7:
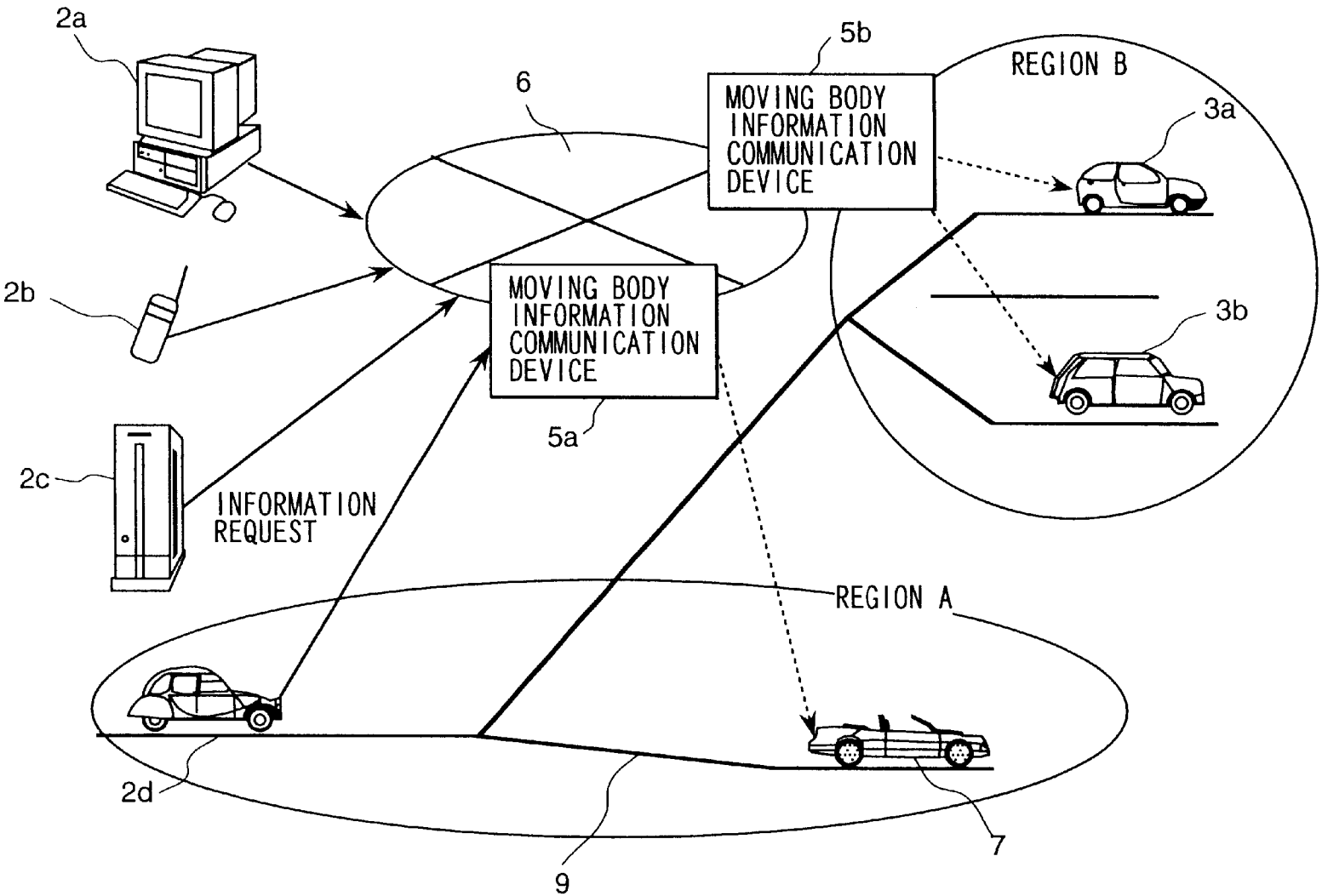
FIG. 7 is a schematic constitution diagram of a moving body information communication system representing another embodiment according to the present invention.

Now, another embodiment of the present invention is shown in which a plurality of centers are included and their managing areas are divided. FIG. 7 shows a schematic constitution of a moving body information communication system representing another embodiment according to the present invention, in which numerals 5*a* and 5*b* represent moving body information communication devices and like FIG. 1 embodiment numerals 2*a*, 2*b*, 2*c* and 2*d* are information requesting sides, namely represent respectively a personal computer, a mobile terminal, an information collecting unit and an information requesting vehicle. The moving body information communication devices 5*a* and 5*b* and the information requesting sides 2*a*, 2*b* and 2*c* are connected via an electrically connected network 6. Further, numeral 7 represents a probe car existing in region A, numerals 8*a* and 8*b* represent probe cars existing in region B and numeral 9 represents a road network across the regions A and B.

The moving body information communication device 5*a* manages probe cars within region A, transmits information request to the probe cars within the region and obtains moving body information therefrom. The moving body information communication device 5*b* has the same functions as above with regard to probe cars within region B. The moving body information communication device 5*a* receives information request from the information requesting sides 2*a*~2*d* via the network 6, transmits information request to a specific moving body within the managing region and obtains moving body information. Hereinbelow, a measure of extracting from a specific moving body information meeting the information request will be explained.

Figures 8, 9:
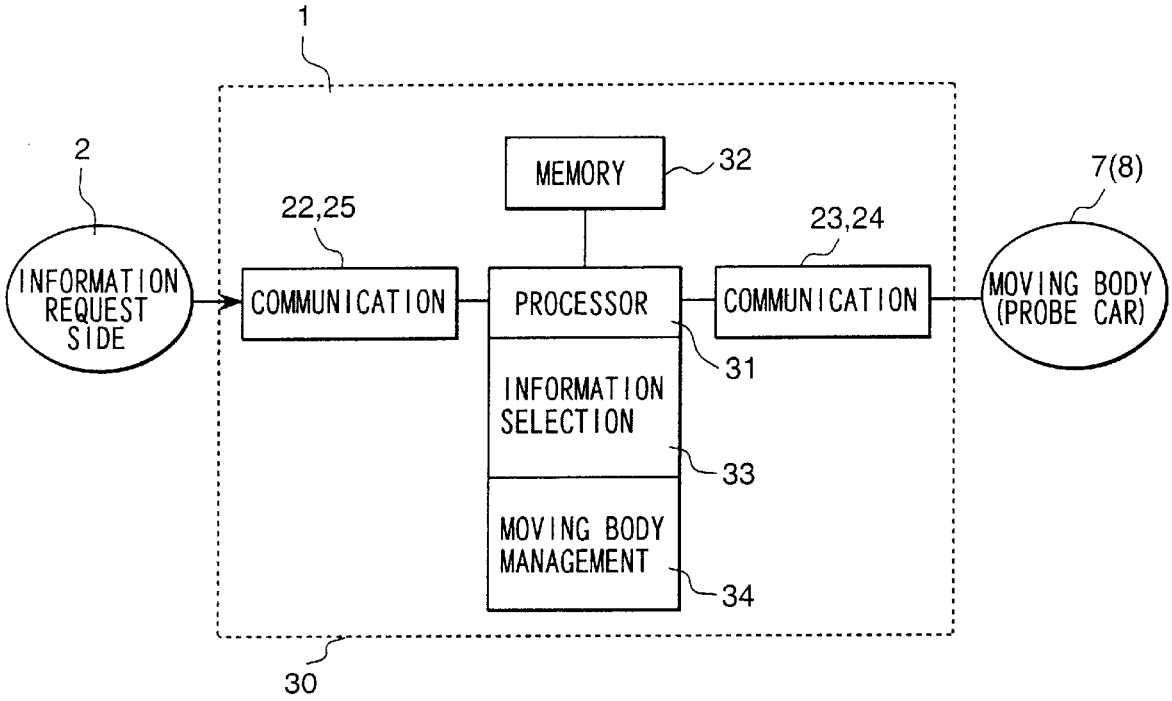
FIG. 8 is a functional block diagram of a moving body information communication device in FIG. 7 embodiment.
FIG. 9 is a format diagram of a moving body management information in FIG. 7 embodiment.

FIG. 8 is a functional block diagram of a moving body information communication device 30 (5, 5*a*, 5*b*) for realizing the moving body information communication system.

The device is provided with a moving body management means 34 in addition to the structure shown in FIG. 2 example.

The moving body management means 34 receives moving body ID and position information which are periodically declared by the moving bodies and holds a moving body management information format as shown in FIG. 9 in the memory 32. The moving body management information includes information obtain time, moving body ID and position information. The processor 31 compares the begin position, via position and via point information (refer to FIG. 4) in the request information which is received from the information request side 2 via the communication means 22 with the moving body management information in the memory 32, specifies a moving body with its ID existing on a route or near the route (for example within 500 m radius) relating to the request information and transmits the request information via the communication means 23.

Figure 10:
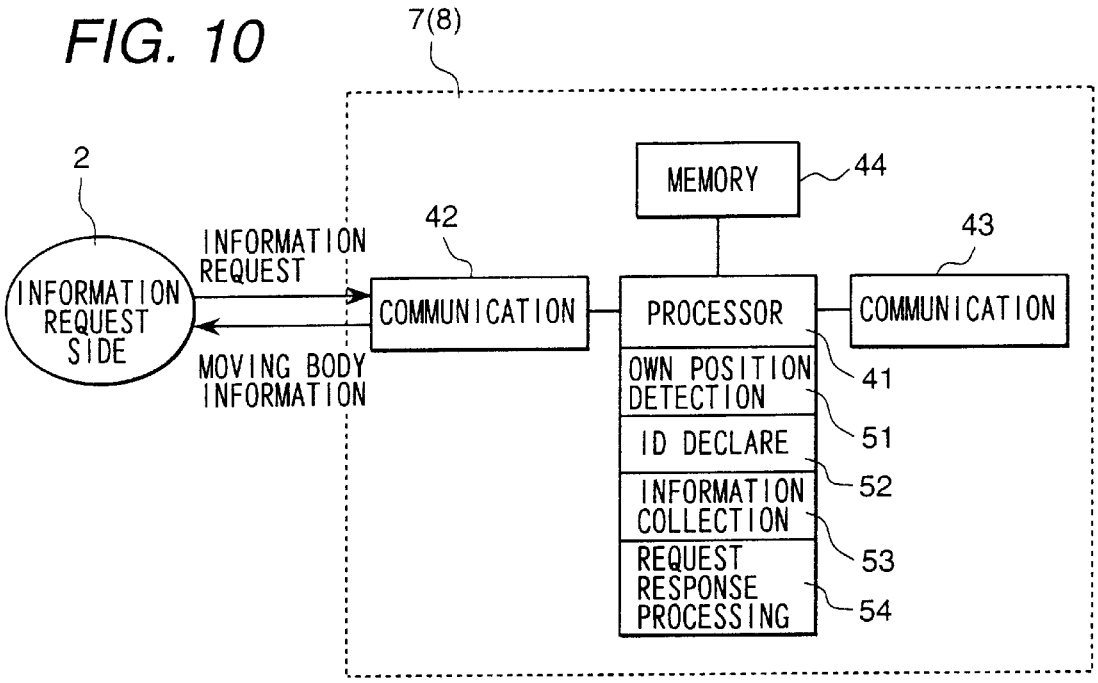
FIG. 10 is a block diagram of a function assigned to a probe car in FIG. 7 embodiment.

FIG. 10 is a functional block diagram of a probe car, in other words a car mounted unit, for realizing the moving body information communication system. A car mounted unit 7 (8) includes a communication means 42 which receives information request from the moving body information communication device 5 and transmits moving body information, a GPS 42 and an own position detecting means 51 for detecting the vehicle position, an ID declaring means 52 which periodically declares the position of the own vehicle and periodically transmits the moving body ID and position information to the moving body management means 34 in the moving body information communication device 5 as shown in FIG. 8, an information collecting means 53 which collects moving body information meeting the information request, a request response processing means 54 which processes the received information request, a processor 41 which realizes the above variety of processings and a memory 44 which stores information.

With the ID declaration, the ID of the car mounted unit is periodically declared to the center side to cause to register the ID at the center. The moving body management means 34 at the center can manage the position of vehicles with a base station level in a moving body communication. In the present embodiment, the GPS is used for own position detection as a position detection sensor, however, in these days some of sole communication unit such as CDMA type portable phone and PHS can detect position and speed of the vehicle, therefore, such can also be used.

Hereinbelow, a processing flow of information collection and request response will be explained. The information collection processing means 53 is a means which collects time, position and sensor information during vehicle travel by making use of a variety of sensors installed in the vehicle and the GPS. The collected information is classified depending on the information types according to the format as shown in FIG. 6 and stored in the memory 44.

Figure 11:
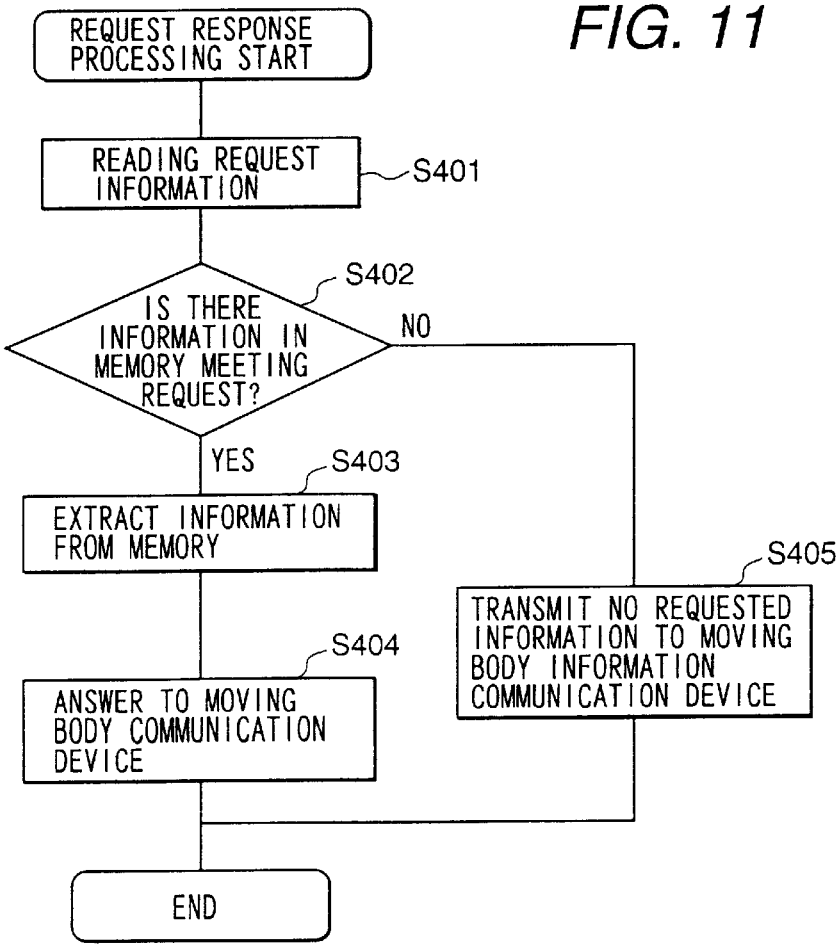
FIG. 11 is a flowchart showing request response processing performed in the probe car in FIG. 7 embodiment.

FIG. 11 shows a flowchart for the request response processing. At first, reading of the request information is performed (S 401). At this step, the request information is read which is received from the moving body information communication device 5 via the communication means 42 and is stored in the memory 44. The request information is expressed in the format as shown in FIG. 4.

Subsequently, judgement of the request information is performed (S 402). At this step, the read request information is compared with the moving body information which is obtained in advance by the information collecting means 53 and stored in the memory 44 and extracts moving body information which meets the conditions with regard to information type, time and position. Namely, the following checks are performed, in that with regard to information type whether the request information coincides with the moving body information, with regard to time the generation time of the request information is compared with the obtain time of the moving body information and it is determined that the difference therebetween is less than the information freshness threshold value as shown in FIG. 5, and with regard to position the information on start position, via position and via point specified in the request information is compared with the moving body management information in the memory and it is determined that the information relates to the route of the request information.

If information meeting the request information exists in the memory, the information is extracted from the memory (S 403) and is returned to the moving body information communication device via the communication means (S 404). On the other hand, if no concerned information is in the memory 44, the fact is returned to the moving body information communication device (S 405).

With the above explained processings, the moving body information communication device can receive only the moving body information meeting the request information. Further, another example in which a modified information collecting means mounted in the car is included for obtaining the moving body information meeting the request information will be explained.

In the above embodiment, only when the moving body information meeting the request information exists, the moving body information is returned. In contrast, in the modified example, even when no moving body information meeting the request information exists, the request information is stored in the memory and when the moving body information meeting the contents of the request information is newly obtained during the travel of the vehicles, the newly obtained moving body information is transmitted to the moving body information communication device.

With this method, although a time lag will be generated with respect to the request information, if the timing requirement with regard to the request information is not so severe, for example, when an upper allowable time limit from the issuance of the request information from the information requesting side to obtaining the moving body information is set long or no limitation is set, it is possible to improve the frequency of returning the moving body information in response to the request information.

According to the present embodiment, the request information is only transmitted to a vehicle which will possibly answer the object information and only the moving body information meeting the object is returned, therefore, the communication traffic is greatly reduced. Further, it is unnecessary to store in advance information having small usage chance at the side of the moving body information communication device, therefore, the storage capacity of the memory belonging to the moving body information communication device can be reduced.

According to the present embodiment, if the information request is one relating to the region which the moving body information communication device manages, the information request is transmitted to probe cars within the region via the communication means 23. Further, when an information requesting side requests moving body information such as necessary time information for a long section and jamming information extending to a plurality of regions which are managed by a plurality of the moving body information communication devices, it is possible to obtain the moving body information covering a plurality of regions with once information request.

Figure 12:
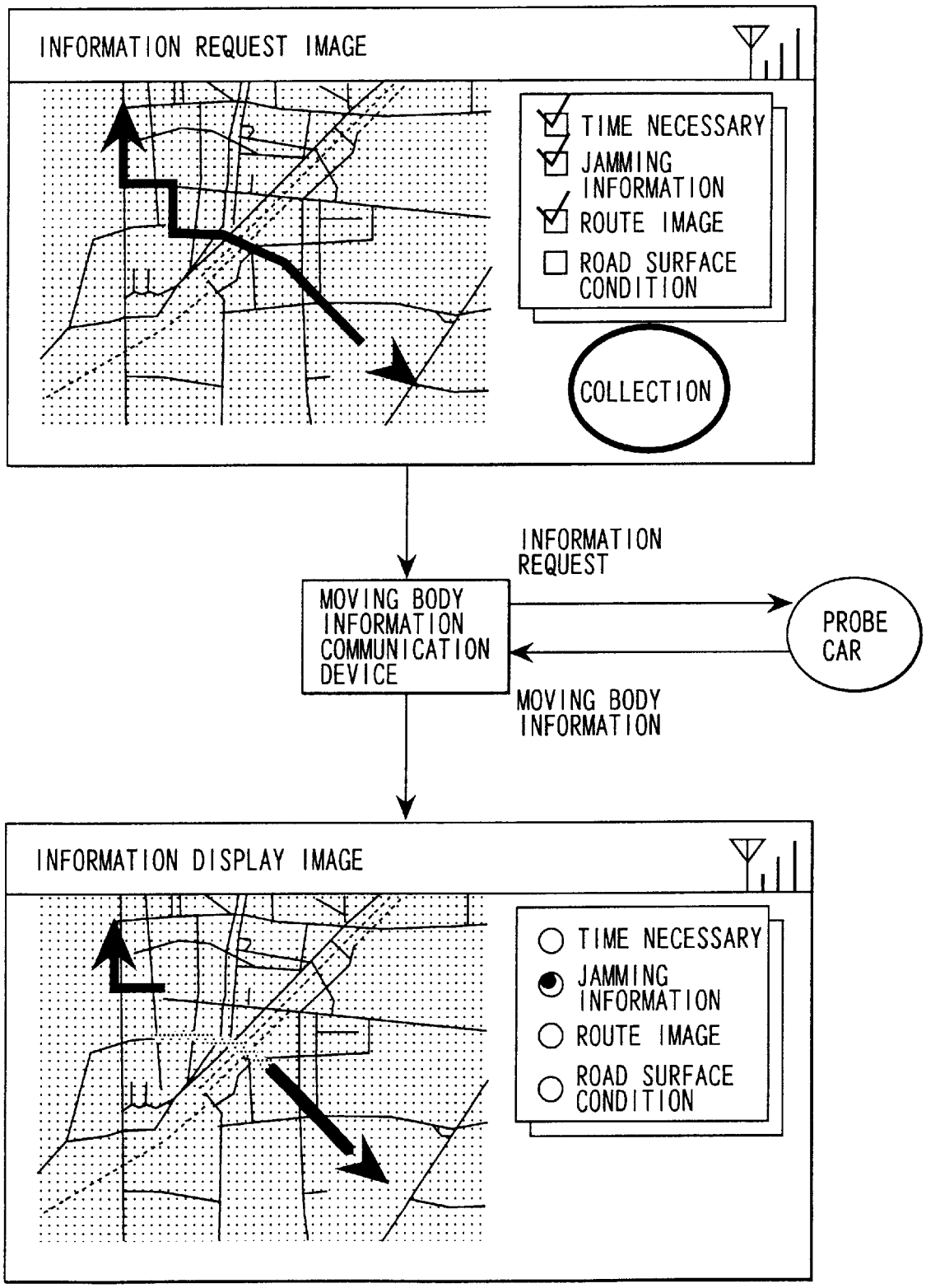
FIG. 12 is an exemplary view showing information input and output screen images at information requesting side in FIG. 7 embodiment.

Now, an application example of the present embodiment will be explained. FIG. 12 shows an example how an information requesting side obtain moving body information, wherein numeral 90 represents a display screen, numeral 91 represents a map image display, numeral 92 represents an information request type selection box, numeral 93 represents an information request issue button and numeral 94 represents an information display type selection box.

An information requester inputs information request through the display screen 90 provided at the information request input unit by making use of a graphical user interface (GUI). It is assumed that the image when the information request is effected is one shown at the upper portion in FIG. 12. The information requester inputs a region of information request on the map image display 91. For example, if a position measurement device such as a GPS is provided at the information requesting side, the own position is displayed in a form of a rectangular mark on the map image display as illustrated. Further, the information requester commands a moving body information requesting by oneself through the information request type selection box 92.

After setting the region and type of the request information, when the information requester presses the information request issue button 93, the information request is issued to the moving body information communication device. After issuing the information request through the button 93, the display screen is moved to a condition of waiting for the moving body information. After the moving body information meeting the information request being collected by the moving body information communication device, the display screen 90 changes to one as shown at lower portion in FIG. 12 to display the moving body information.

The example as shown at the lower portion in FIG. 12 is one illustrating jamming information. Further, through the information display type selection box 94 moving body information to be displayed is changed-over. Further, through varying the map image display 91 depending on the types of display information it is possible to display a plurality type of obtained moving body informations.

According to the present invention, a moving body information communication device can be provided which permits to collect information relating to a specific region in response to information request from an information requesting side, and a moving body information communication system can be built which divides processings of the information collected by moving bodies.

What is claimed is:

1. A moving body information communication device comprising:

a first communication means which receives request information from an information requesting side moving body; and a second communication means which transmits the request information to at least one moving body existing at a predetermined region, wherein when moving body information corresponding to the request information is transmitted from the moving body existing at the predetermined region, the moving body information is transferred to the information requesting side moving body.

2. A moving body information communication device according to claim 1, further comprising a memory which stores moving body information which is always being received from each moving body, wherein when the request information is stored in the memory, the moving body information communication device reads the stored information and transfers the same to the information requesting side moving body and when no request information is stored in the memory, the device transmits the request information to the moving body existing at the predetermined region.

3. A moving body information communication device according to claim 2, wherein when the request information is not stored in the memory, it is judged whether the communication traffic of the moving body information communication device is within a predetermined allowable value, and when the communication traffic is within the predetermined allowable value, the device transmits the request information to the information requesting side moving body.

4. A moving body information communication system comprising a plurality of moving body information communication devices connected through a network, wherein each of the moving body information communication devices is constituted according to claim 3 and further comprises a moving body management means which receives moving body identification ID and position information periodically declared by the moving body and manages the same.

5. A moving body information communication system comprising a plurality of moving body information communication devices connected through a network, wherein each of the moving body information communication devices is constituted according to claim 2 and further comprises a moving body management means which receives moving body identification ID and position information periodically declared by the moving body and manages the same.

6. A moving body information communication system comprising a plurality of moving body information communication devices connected through a network, wherein each of the moving body information communication devices is constituted according to claim 1 and further comprises a moving body management means which receives moving body identification ID and position information periodically declared by the moving body and manages the same.

7. A moving body information communication device comprising:

a first communication means which receives request information from an information requesting side;

a second communication means which transmits the request information to at least one moving body existing at a predetermined region; and a memory which stores moving body information which is always being received from the moving body, wherein when the request information is stored in the memory, the moving body information stored in the memory is classified according to its freshness and when the freshness of the information is within a predetermined freshness threshold value, the moving body information is determined to be transferable to the information requesting side, the moving body information communication device reads the transferable stored information and transfers the same to the information requesting side, and when no request information is stored in the memory, the device transmits they request-information to the moving body.

8. A moving body information communication device according to claim 7, wherein when the request information is not stored in the memory, it is judged whether the communication traffic of the moving body information communication device is within a predetermined allowable value, and when the communication traffic is within the predetermined allowable value, the device transmits the request information to the moving body.

9. A moving body information communication system comprising a plurality of moving body information communication devices connected through a network, wherein each of the moving body information communication devices is constituted according to claim 8 and further comprises a moving body management means which receives moving body identification ID and position information periodically declared by the moving body and manages the same.

10. A moving body information communication system comprising a plurality of moving body information communication devices connected through a network, wherein each of the moving body information communication devices is constituted according to claim 7 and further comprises a moving body management means which receives moving body identification ID and position information periodically declared by the moving body and manages the same.

11. A method of moving body information communication between an information requesting side, a moving body information communication device and a moving body, wherein when the moving body information communication device receives request information from the information requesting side, the device retrieves a memory and when there is moving body information meeting the request information therein, the device returns the moving body information meeting the request information contained in the memory to the information requesting side and when there is no moving body information meeting the request information therein, the device transmits the request information to the moving body, when the moving body which is always collecting moving body information holds the moving body information meeting the received information request, the moving body transmits the holding moving body information to the moving body information communication device, and the moving body information communication device further transmits the moving body information received from the moving body to the information requesting side.

12. A method according to claim 11, wherein the moving body manages a region where the moving body exists and ID information thereof and transmits the same together with the moving body information.

* * * * *